US010279823B2

(12) United States Patent
Sharma et al.

(10) Patent No.: US 10,279,823 B2
(45) Date of Patent: May 7, 2019

(54) SYSTEM FOR CONTROLLING OR MONITORING A VEHICLE SYSTEM ALONG A ROUTE

(71) Applicant: General Electric Company, Schenectady, NY (US)

(72) Inventors: Ankit Sharma, Bangalore (IN); David Allen Eldredge, Melbourne, FL (US); Saravanan Thiyagarajan, Bangalore (IN); William Cherrick Schoonmaker, Melbourne, FL (US); Joseph Daniel Wakeman, Lawrence Park, PA (US); Kaitlyn Ann Hrdlicka, Lawrence Park, PA (US); Prakarsh Paritosh, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/231,078

(22) Filed: Aug. 8, 2016

(65) Prior Publication Data

US 2018/0037241 A1 Feb. 8, 2018

(51) Int. Cl.
*B61L 3/00* (2006.01)
*B61L 3/02* (2006.01)

(52) U.S. Cl.
CPC ..... *B61L 3/006* (2013.01); *B61L 3/008* (2013.01); *B61L 3/02* (2013.01)

(58) Field of Classification Search
CPC ..... B61L 3/006; B61L 3/008; B61L 3/02
USPC ..... 701/20
See application file for complete search history.

(56) References Cited

U.S. PATENT DOCUMENTS 7,386,391 B2 * 6/2008 Morariu ..... B61L 27/0027 701/117
8,521,345 B2 8/2013 Cooper et al.
8,655,516 B2 2/2014 Noffsinger et al.
(Continued)

FOREIGN PATENT DOCUMENTS

WO 2010/078133 A1 7/2010

OTHER PUBLICATIONS

International Search Report and Written Opinion issued in connection with corresponding PCT Application No. PCT/US2017/042516 dated Oct. 18, 2017.

*Primary Examiner* — Atul Trivedi
(74) *Attorney, Agent, or Firm* — GE Global Patent Operation; John A. Kramer

(57) ABSTRACT

A method includes generating a trip plan that dictates operational settings to be implemented by a vehicle system moving along a route. The trip plan is based on a temporary work order issued for a restricted segment of the route. The work order provides a maximum speed through the restricted segment for a limited time period that is expressed using a time standard. One or more of the operational settings of the trip plan specify movement of the vehicle system through the restricted segment at a vehicle speed that is less than or equal to the maximum speed. In response to determining that the temporary work order has expired, the method includes at least one of prompting an operator of the vehicle system to confirm that the work order has expired or generating a new trip plan in which the vehicle system exceeds the maximum speed through the restricted segment.

23 Claims, 4 Drawing Sheets

(56) References Cited

U.S. PATENT DOCUMENTS

| | | | | |
|---|---|---|---|---|
| 8,805,605 | B2 * | 8/2014 | Cooper | B61L 27/0027 701/93 |
| 9,308,902 | B1 | 4/2016 | Noffsinger | |
| 2001/0037174 | A1 * | 11/2001 | Dickerson | G07B 15/00 701/400 |
| 2006/0200437 | A1 | 9/2006 | Howlett et al. | |
| 2009/0198391 | A1 | 8/2009 | Kumar et al. | |
| 2010/0023190 | A1 * | 1/2010 | Kumar | B61L 3/006 701/20 |
| 2010/0153419 | A1 * | 6/2010 | Daum | G06F 17/30575 707/758 |
| 2015/0073692 | A1 * | 3/2015 | Malikopoulos | B60W 50/14 701/123 |
| 2016/0031459 | A1 | 2/2016 | Murren et al. | |
| 2016/0046308 | A1 * | 2/2016 | Chung | B61L 25/025 701/20 |
| 2016/0078695 | A1 * | 3/2016 | McClintic | G06Q 10/06 701/29.4 |

* cited by examiner

SYSTEM FOR CONTROLLING OR MONITORING A VEHICLE SYSTEM ALONG A ROUTE

FIELD

Embodiments of the subject matter described herein relate to controlling or monitoring a vehicle system as the vehicle system travels along a designated route.

BACKGROUND

Some known vehicle systems may travel according to a trip plan that provides instructions for the vehicle system to implement during movement of the vehicle system so that the vehicle system meets or achieves certain objectives during the trip. For example, the trip plan may dictate throttle settings or brake settings of the vehicle system as a function of time, location, and/or other parameters. The objectives for the trip may include reaching the arrival location at or before a predefined arrival time, increasing fuel efficiency (relative to the fuel efficiency of the vehicle system traveling without following the trip plan), abiding by speed limits and emissions limits, and the like.

For example, the Trip Optimizer™ system of General Electric Company can create a trip plan by collecting various input information related to the vehicle system and the trip, such as the length and weight of the vehicle system, the grade and conditions of the route that the vehicle will be traversing, weather conditions, performance of the rail vehicle, or the like. The input information may also include one or more "slow orders" that have been issued for respective segments of the route. A slow order specifies a maximum speed at which a vehicle system may travel through the respective segment. A slow order may be applied, for example, to a segment of the route where individuals (e.g., construction workers, inspectors, or the like) may be located near the route or where conditions of the route may be poor (e.g., debris along the route). Presently, slow orders include the location of the segment and the maximum speed at which the vehicle system may travel.

A single trip, however, may be hundreds of kilometers or more and include several slow orders. As an example, a single trip may be more than a thousand kilometers and may travel through thirty or more segments with slow orders. Due to the length and duration of the trip, a slow order may have expired when the vehicle system arrives at the respective segment. If the operator is aware that the slow order has expired, the operator may break from automatic control and manually control the vehicle system through the respective segment. It is generally desirable, however, to increase the time in which the vehicle system is automatically controlled or, for those instances in which the vehicle system is controlled manually, to guide the operator along the segment using correct information.

BRIEF DESCRIPTION

In an embodiment, a method includes generating a trip plan that dictates or specifies operational settings to be implemented by a vehicle system moving along a route. The trip plan is based on a temporary work order issued for a restricted segment of the route. The temporary work order provides a maximum speed through the restricted segment for a limited time period that is expressed using a designated time standard. One or more of the operational settings of the trip plan specify movement of the vehicle system through the restricted segment at a vehicle speed that is less than or equal to the maximum speed. The method also includes controlling the vehicle system in accordance with the trip plan as the vehicle system moves along the route. The method also includes determining a current time as the vehicle system approaches the restricted segment or moves through the restricted segment. The current time is in the designated time standard or in a different time standard that is a function of the designated time standard. The method also includes determining that the temporary work order has expired based on the current time and the limited time period of the temporary work order. In response to determining that the temporary work order has expired, the method includes at least one of prompting an operator of the vehicle system to confirm that the temporary work order has expired, generating a new trip plan in which the vehicle system exceeds the maximum speed through the restricted segment, or modifying the operational settings of the trip plan such that the vehicle system exceeds the maximum speed through the restricted segment.

In one or more aspects, the trip plan has a first trip duration and a first amount of fuel. The new trip plan may be configured to have at least one of (a) a second trip duration that is essentially equal to the first trip duration or (b) a second amount of fuel that is less than the first amount of fuel.

In one or more aspects, the vehicle system includes an embedded system that is disposed onboard the vehicle system and performs the step of generating the trip plan. The method may also include receiving, at the embedded system, the temporary work order that is applied to the restricted segment prior to departure from a starting location of the route or while the vehicle system is moving along the route.

In an embodiment, a method includes generating a trip plan at a first embedded system that is disposed onboard a vehicle system. The trip plan dictates or specifies operational settings to be implemented by the vehicle system moving along a route. The trip plan is based on a temporary work order issued for a restricted segment of the route. The temporary work order provides a maximum speed through the restricted segment for a limited time period that is expressed using a designated time standard. One or more of the operational settings of the trip plan specify movement of the vehicle system through the restricted segment at a vehicle speed that is less than or equal to the maximum speed. The method also includes communicating the trip plan from the first embedded system to a second embedded system. The method also includes controlling the vehicle system in accordance with the trip plan as the vehicle system moves along the route. The vehicle system is controlled by the second embedded system. The method also includes determining a current time, at the first embedded system, as the vehicle system approaches the restricted segment or moves through the restricted segment. The current time is in the designated time standard or in a different time standard that is a function of the designated time standard. The method also includes communicating the current time from the first embedded system to a second embedded system. The method also includes determining, at the second embedded system, that the temporary work order has expired based on the current time and the limited time period of the temporary work order, wherein, in response to determining that the temporary work order has expired. The method includes at least one of prompting an operator of the vehicle system to confirm that the temporary work order has expired, generating a new trip plan in which the vehicle system exceeds the maximum speed through the restricted segment, or modifying the operational settings of the trip plan such that the vehicle system exceeds the maximum speed through the restricted segment.

In an embodiment, a system includes a control system that is disposed onboard a vehicle system. The control system includes one or more processors and is configured to generate a trip plan that dictates operational settings to be implemented by the vehicle system moving along a route. The trip plan is based on a temporary work order issued for a restricted segment of the route. The temporary work order provides a maximum speed through the restricted segment for a limited time period that is expressed using a designated time standard. One or more of the operational settings of the trip plan specify movement of the vehicle system through the restricted segment at a vehicle speed that is less than or equal to the maximum speed. The control system is also configured to control the vehicle system in accordance with the trip plan as the vehicle system moves along the route. The control system is also configured to determine a current time as the vehicle system approaches the restricted segment or moves through the restricted segment. The current time is in the designated time standard or in a different time standard that is a function of the designated time standard. The control system is also configured to determine that the temporary work order has expired based on the current time and the limited time period of the temporary work order. In response to determining that the temporary work order has expired, the control system is also configured to at least one of prompt an operator of the vehicle system to confirm that the temporary work order has expired, generate a new trip plan in which the vehicle system exceeds the maximum speed through the restricted segment, or modify the operational settings of the trip plan such that the vehicle system exceeds the maximum speed through the restricted segment.

In one more aspects, the control system includes first and second embedded systems. The first embedded system includes one or more processors and memory and the second embedded system includes one or more processors and memory. The first embedded system includes an antenna and is configured to receive input information from an off-board system. The first embedded system is configured to generate the trip plan using the input information. The second embedded system is configured to control the vehicle system in accordance with the trip plan as the vehicle system moves along the route.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
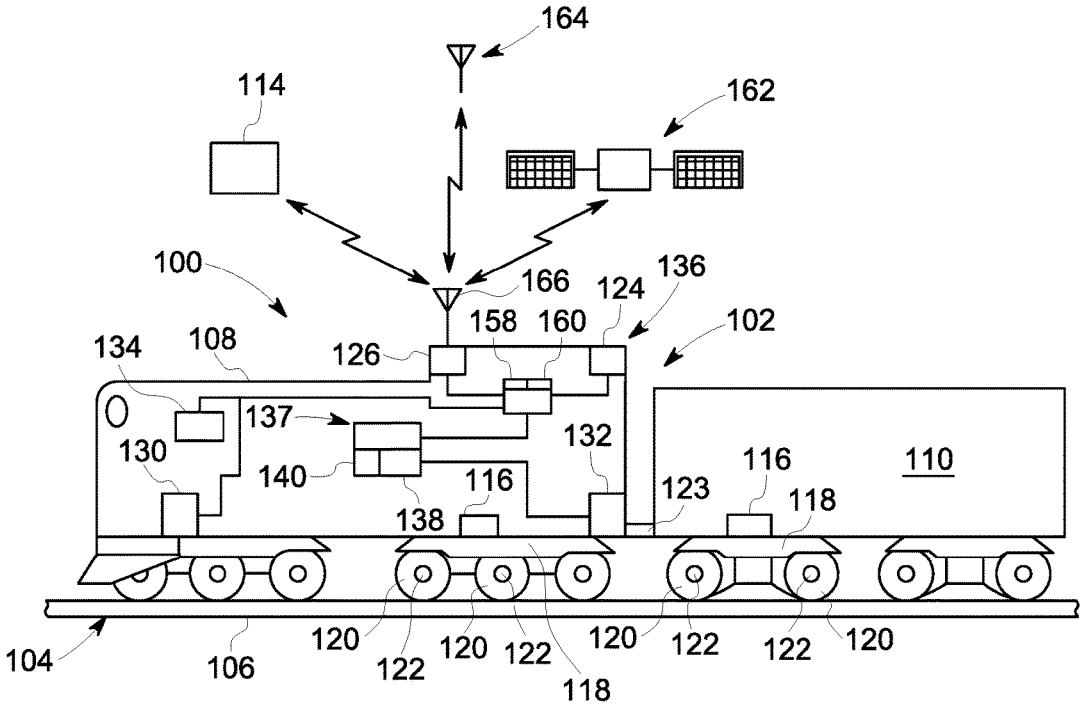
FIG. 1 is a schematic diagram of one embodiment of a control system disposed onboard a vehicle system.

Embodiments of the subject matter disclosed herein describe methods and systems used in conjunction with controlling a vehicle system that travels along a route. The embodiments provide methods and systems for controlling the vehicle system along the route after determining that a temporary work order issued for a segment of the route has expired. In particular, embodiments may modify or regenerate trip plans and/or reduce an amount of time spent manually controlling the vehicle system.

A more particular description of the inventive subject matter briefly described above will be rendered by reference to specific embodiments thereof that are illustrated in the appended drawings. The inventive subject matter will be described and explained with the understanding that these drawings depict only typical embodiments of the inventive subject matter and are not therefore to be considered to be limiting of its scope. Wherever possible, the same reference numerals used throughout the drawings refer to the same or like parts. To the extent that the figures illustrate diagrams of the functional blocks of various embodiments, the functional blocks are not necessarily indicative of the division between hardware and/or circuitry. Thus, for example, components represented by multiple functional blocks (for example, processors, controllers, or memories) may be implemented in a single piece of hardware (for example, a general purpose signal processor, microcontroller, random access memory, hard disk, or the like). Similarly, any programs and devices may be standalone programs and devices, may be incorporated as subroutines in an operating system, may be functions in an installed software package, or the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "module," "system," "device," or "unit," may include a hardware and/or software system and circuitry that operate to perform one or more functions. For example, a module, unit, device, or system may include a computer processor, controller, or other logic-based device that performs operations based on instructions stored on a tangible and non-transitory computer readable storage medium, such as a computer memory. Alternatively, a module, unit, device, or system may include a hard-wired device that performs operations based on hard-wired logic and circuitry of the device. The modules, units, or systems shown in the attached figures may represent the hardware and circuitry that operates based on software or hardwired instructions, the software that directs hardware to perform the operations, or a combination thereof. The modules, systems, devices, or units can include or represent hardware circuits or circuitry that include and/or are connected with one or more processors, such as one or computer microprocessors.

As used herein, an "embedded system" is a specialized computing system that is integrated as part of a larger system, such as a larger computing system (e.g., control system) or a vehicle system. An embedded system includes a combination of hardware and software components that form a computational engine that will perform one or more specific functions. Embedded systems are unlike general computers, such as desktop computers, laptop computers, or tablet computers, which may be programmed or re-programmed to accomplish a variety of disparate tasks. Embedded systems include one or more processors (e.g., microcontroller or microprocessor) or other logic-based devices and memory (e.g., volatile and/or non-volatile) and may optionally include one or more sensors, actuators, user interfaces, analog/digital (AD), and/or digital/analog (DA) converters. An embedded system may include a clock (referred to as system clock) that is used by the embedded system for performing its intended function(s), recording data, and/or logging designated events during operation.

Embedded systems described herein include those that may be used to control a vehicle system, such as a locomotive or a consist that includes the locomotive. These embedded systems are configured to operate in time-constrained environments, such as those experienced during a trip, that require the embedded systems to make complex calculations that a human would be unable to perform in a commercially reasonable time. Embedded systems may also be reactive such that the embedded systems change the performance of one or more mechanical devices (e.g., traction motors, braking subsystems) in response to detecting an operating condition. Embedded systems may be discrete units. For example, at least some embedded systems may be purchased and/or installed into the larger system as separate or discrete units.

Non-limiting examples of embedded systems that may be used by a vehicle system, such as those described herein, include a communication management unit (CMU), a consolidated control architecture (CCA), a locomotive command and control module (LCCM), a high performance extended applications platform (HPEAP), and an energy management system (EMS). Such embedded systems may be part of a larger system, which may be referred to as a control system. The larger system may also be the vehicle system (e.g., locomotive). In certain embodiments, the CMU is configured to communicate with an off-board system, such as a dispatch, and generate a trip plan based on input information received from the off-board system. In certain embodiments, the CCA may implement or execute the trip plan by controlling one or more traction motors and braking subsystems. The CCA may receive the trip plan from the CMU and communicate with the CMU as the vehicle system moves along the route. For example, the CMU may communicate a current time to the CCA.

As described herein, the system (e.g., the control system or the vehicle system) is configured to implement a trip plan that is based on a temporary work order that has been issued for a restricted segment of the route. A temporary work order can be any issued temporary order, restriction, instruction, rule, or the like that instructs or requires the vehicle system to move at or less than a designated vehicle speed limit that is different that the vehicle speed limit that is ordinarily applied to the restricted segment. For example, the temporary work order may be issued by a railroad or government agency and may be issued for a variety of reasons (e.g., safety of personnel working alongside the route, safety of individuals and cargo on the vehicle system, etc.). A temporary work order includes, for example, a slow order or a designated temporary work zone. In some applications, the trip plan may be implemented differently based on the type of temporary work order. For example, the trip plan may require that the vehicle system operate in a manual mode along the restricted segment for a first type of temporary work order (e.g., temporary work zone), but operate in an autonomous mode for a second type of temporary work order (e.g., slow order). Accordingly, portions of the trip plan may be implemented manually by an operator or autonomously by the vehicle system. In other embodiments, the entire trip plan is implemented autonomously by the vehicle system. The operator may interrupt automatic control, if necessary.

As used herein, a "restricted segment" refers to a segment of the route that has a temporary work order (e.g., slow order, temporary work zone) issued therefor or applied thereto. The restricted segment has a distance that is less than the entire route and, in many cases, significantly less. For example, the route for the trip may be hundreds or thousands of kilometers (km). The restricted segment, however, may be only 1-10 km. It should be understood that the length or distance of the restricted segment may be less than 1 km or more than 10 km. It should also be understood that a single trip may include more than one restricted segment. For example, a single trip may include several restricted segments (e.g., four or more restricted segments) along the route. In other embodiments, the trip may include three or fewer restricted segments.

The temporary work order specifies a maximum speed for moving through the restricted segment (e.g., at most 50 km/hour (kph)). The temporary work order also specifies a beginning point of the restricted segment along the route and an end point of the restricted segment along the route. For example, the beginning points and end points may be identified by markers (e.g., mile markers) along the route, geographical coordinates (e.g., latitude/longitude coordinates), landmarks, track features (e.g., junctions), or other data that identifies where the restricted segment is located along the route. The maximum speed is less than a speed at which the vehicle system may typically pass along the same restricted segment when a temporary work order is not applied. For example, if the vehicle system is permitted to move at 80 kph or less when the temporary work order is not applied, the maximum speed provided by the temporary work order is less (e.g., at most 60 kph, at most 50 kph, at most 40 kph, at most 30 kph, at most 20 kph, etc.). It should be understood that units or speeds may also be expressed in miles (e.g., miles/hour).

The temporary work order may also specify a limited time period in which the temporary work order is applied or is valid for the restricted segment. The limited time period may be expressed in a designated time standard. The designated time standard may be a predetermined time standard, such as the coordinated universal time (UTC). One example of a limited time period is 13:00-18:00 UTC. Alternatively, the designated time standard may also be the local time. For example, when the restricted segment is located within the Eastern Time Zone of the United States in an area that observes standard time (autumn/winter), the designated time standard is the Eastern Standard Time (EST), which is 5 hours behind UTC. Another example of a limited time period is 1:00 pm-6:00 pm EST. Accordingly, a temporary work order issued for a restricted segment may (a) specify the beginning point and end point of the restricted segment; (b) specify the maximum speed at which the vehicle system may move through the restricted segment; and (c) specify the limited time period at which the temporary work order is valid.

Embodiments may determine a current time as the vehicle system moves along the route. As used herein, the "current time" is either expressed in the designated time standard or expressed in a different time standard that is a function of the designated time standard. For example, if the designated time standard is a regional time standard of the geographical region that includes the restricted segment (e.g., EST), the current time may be expressed in EST or in UTC, which has a known relationship with respect to EST. More specifically, UTC is five hours ahead of EST.

Temporary work orders may correspond to overlapping or non-overlapping restricted segments. For example, a temporary work order may be issued for a restricted segment that extends from a beginning point at 10 km to an end point at 12 km. Another temporary work order may be issued for a restricted segment that extends from a beginning point at 12 km to an end point at 15 km. These restricted segments are non-overlapping. As another example, a temporary work order may be issued for a restricted segment that extends from a beginning point at 15 km to an end point at 20 km. Another temporary work order may be issued for a restricted segment that extends from a beginning point at 18 km to an end point at 22 km. Such restricted segments are overlapping. In many cases, the restricted segments along a route are separate from each other. For example, a first restricted segment may extend from a beginning point at 30 km to an end point at 32 km and the next restricted segment may extend from a beginning point at 55 km to an end point at 60 km. In between these restricted segments, the vehicle system may be permitted to travel at a maximum speed that is typically applicable for the segment between the restricted segments.

Embodiments that include trains may be particularly suitable for routes that do not include a positive train control (PTC) infrastructure. PTC is configured to prevent train-to-train collisions, overspeed derailments, incursions into established work zone limits, and the movement of a train through a switch left in the wrong position. A PTC system may utilize wireless communication to provide in-cab signals to a human operator (e.g., train engineer) and to enable a dispatcher to stop a train remotely in an emergency. A PTC system is a communications and signaling system that uses signals and sensors along a route to communicate a train location, speed restrictions, and moving authority. If the locomotive is violating a speed restriction or moving authority, onboard equipment may automatically slow or stop the train.

FIG. 1 illustrates a schematic diagram of a control system 100 according to an embodiment. The control system 100 is disposed on a vehicle system 102. The vehicle system 102 is configured to travel on a route 104. The vehicle system 102 is configured to travel along the route 104 on a trip from a starting or departure location to a destination or arrival location. The vehicle system 102 includes a propulsion-generating vehicle 108 and a non-propulsion-generating vehicle 110 that are mechanically interconnected to one another in order to travel together along the route 104. Two or more coupled propulsion-generating vehicles 108 may form a consist or group. The vehicle system 102 may include a single consist or multiple consists interspersed along the vehicle system 102. In a distributed power operation, the consist may include a lead propulsion-generating vehicle mechanically linked to one or more remote propulsion-generating vehicles, where operational settings (e.g., tractive and braking settings) of the remote propulsion-generating vehicles are controlled by the lead propulsion-generating vehicle. Alternatively, the vehicle system 102 may be formed from a single propulsion-generating vehicle 108.

The propulsion-generating vehicle 108 is configured to generate tractive efforts to propel (for example, pull or push) the non-propulsion-generating vehicle 110 along the route 104. The propulsion-generating vehicle 108 includes a propulsion subsystem, including one or more traction motors, that generates tractive effort to propel the vehicle system 102. The propulsion-generating vehicle 108 also includes a braking subsystem that generates braking effort for the vehicle system 102 to slow down or stop itself from moving. Optionally, the non-propulsion-generating vehicle 110 includes a braking subsystem but not a propulsion subsystem. The propulsion-generating vehicle 108 is referred to herein as a propulsion vehicle 108, and the non-propulsion-generating vehicle 110 is referred to herein as a car 110. Although one propulsion vehicle 108 and one car 110 are shown in FIG. 1, the vehicle system 102 may include multiple propulsion vehicles 108 and/or multiple cars 110. In an alternative embodiment, the vehicle system 102 only includes the propulsion vehicle 108 such that the propulsion vehicle 108 is not coupled to the car 110 or another kind of vehicle.

The control system 100 is used to control the movements of the vehicle system 102. In the illustrated embodiment, the control system 100 is disposed entirely on the propulsion vehicle 108. The control system 100 may include a plurality of embedded sub-systems, which are hereinafter referred to as embedded systems. In other embodiments, however, one or more components of the control system 100 may be distributed among several vehicles, such as the vehicles 108, 110 that make up the vehicle system 102. For example, some components may be distributed among two or more propulsion vehicles 108 that are coupled together in a group or consist. In an alternative embodiment, at least some of the components of the control system 100 may be located remotely from the vehicle system 102, such as at a dispatch location 114. The remote components of the control system 100 may communicate with the vehicle system 102 (and with components of the control system 100 disposed thereon).

In the illustrated embodiment, the vehicle system 102 is a rail vehicle system, and the route 104 is a track formed by one or more rails 106. The propulsion vehicle 108 may be a rail vehicle (e.g., locomotive), and the car 110 may be a rail car that carries passengers and/or cargo. The propulsion vehicle 108 may be another type of rail vehicle other than a locomotive. In another embodiment, the propulsion-generating vehicles 108 may be trucks and/or automobiles configured to drive on a track 106 composed of pavement (e.g., a highway). The vehicle system 102 may be a group or consist of trucks and/or automobiles that are logically coupled so as to coordinate movement of the vehicles 108 along the pavement. In other embodiments, the vehicles 108 may be off-highway vehicles (e.g., mining vehicles and other vehicles that are not designed for or permitted to travel on public roadways) traveling on a track 106 of earth, marine vessels traveling on a track 106 of water, aerial vehicles traveling on a track 106 of air, and the like. Thus, although some embodiments of the inventive subject matter may be described herein with respect to trains, locomotives, and other rail vehicles, embodiments of the inventive subject matter also are applicable for use with vehicles generally.

The vehicles 108, 110 of the vehicle system 102 each include multiple wheels 120 that engage the route 104 and at least one axle 122 that couples left and right wheels 120 together (only the left wheels 120 are shown in FIG. 1). Optionally, the wheels 120 and axles 122 are located on one or more trucks or bogies 118. Optionally, the trucks 118 may be fixed-axle trucks, such that the wheels 120 are rotationally fixed to the axles 122, so the left wheel 120 rotates the same speed, amount, and at the same times as the right wheel 120. The propulsion vehicle 108 is mechanically coupled to the car 110 by a coupler 123. The coupler 123 may have a draft gear configured to absorb compression and tension forces to reduce slack between the vehicles 108, 110. Although not shown in FIG. 1, the propulsion vehicle 108 may have a coupler located at a front end 125 of the propulsion vehicle 108 and/or the car 110 may have a coupler located at a rear end 127 of the car 110 for mechanically coupling the respective vehicles 108, 110 to additional vehicles in the vehicle system 102.

As the vehicle system 102 travels along the route 104 during a trip, the control system 100 may be configured to measure, record, or otherwise receive and collect input information about the route 104, the vehicle system 102, and the movement of the vehicle system 102 on the route 104. For example, the control system 100 may be configured to monitor a location of the vehicle system 102 along the route 104 and a speed at which the vehicle system 102 moves along the route 104, which is hereinafter referred to as a vehicle speed.

In addition, the control system 100 may be configured to generate a trip plan and/or a control signal based on such input information. The trip plan and/or control signal designates one or more operational settings for the vehicle system 102 to implement or execute during the trip as a function of time and/or location along the route 104. The operational settings may include tractive and braking settings for the vehicle system 102. For example, the operational settings may include dictated speeds, throttle settings, brake settings, accelerations, or the like, of the vehicle system 102 as a function of time and/or distance along the route 104 traversed by the vehicle system 102.

The trip plan is configured to achieve or increase specific goals or objectives during the trip of the vehicle system 102, while meeting or abiding by designated constraints, restrictions, and limitations. Some possible objectives include increasing energy (e.g., fuel) efficiency, reducing emissions generation, reducing trip duration, increasing fine motor control, reducing wheel and route wear, and the like. The constraints or limitations include speed limits, schedules (such as arrival times at various designated locations), environmental regulations, standards, and the like. The operational settings of the trip plan are configured to increase the level of attainment of the specified objectives relative to the vehicle system 102 traveling along the route 104 for the trip according to operational settings that differ from the one or more operational settings of the trip plan (e.g., such as if the human operator of the vehicle system 102 determines the tractive and brake settings for the trip). One example of an objective of the trip plan is to increase fuel efficiency (e.g., by reducing fuel consumption) during the trip. By implementing the operational settings designated by the trip plan, the fuel consumed may be reduced relative to travel of the same vehicle system along the same segment of the route in the same time period but not according to the trip plan.

The trip plan may be established using an algorithm based on models for vehicle behavior for the vehicle system 102 along the route. The algorithm may include a series of non-linear differential equations derived from applicable physics equations with simplifying assumptions, such as described in connection with U.S. patent application Ser. No. 12/955,710, U.S. Pat. No. 8,655,516, entitled "Communication System for a Rail Vehicle Consist and Method for Communicating with a Rail Vehicle Consist," which was filed 29 Nov. 2010 (the "'516 Patent"), the entire disclosure of which is incorporated herein by reference.

The control system 100 may be configured to control the vehicle system 102 along the trip based on the trip plan, such that the vehicle system 102 travels according to the trip plan. In a closed loop mode or configuration, the control system 100 may autonomously control or implement propulsion and braking subsystems of the vehicle system 102 consistent with the trip plan, without requiring the input of a human operator. In an open loop coaching mode, the operator is involved in the control of the vehicle system 102 according to the trip plan. For example, the control system 100 may present or display the operational settings of the trip plan to the operator as directions on how to control the vehicle system 102 to follow the trip plan. The operator may then control the vehicle system 102 in response to the directions. As an example, the control system 100 may be or include a Trip Optimizer™ system from General Electric Company, or another energy management system. For additional discussion regarding a trip plan, see the '516 Patent.

The control system 100 may include at least on embedded system. In the illustrated embodiment, the control system 100 includes a first embedded system 136 and a second embedded system 137 that are communicatively coupled to each other. Although the control system 100 is shown as having only two embedded systems, it should be understood that the control system 100 may have more than two embedded systems. In certain embodiments, the first embedded system 136 may be a CMU and the second embedded system 137 may be a CCA.

The first embedded system 136 includes one or more processors 158 and memory 160. The one or more processors 136 may generate a trip plan based on input information received from the second embedded system 137 or other components of the vehicle system 102 and/or input information received from a remote location. As used herein, a trip plan is "generated" when an entire trip plan is created anew or an existing plan is modified based on, for example, recently received input information. For example, a new trip plan may be generated after determining that a temporary work order is no longer valid. The new trip plan may be based on the trip plan that the vehicle system was implementing prior to determining that the temporary work order is no longer valid.

The first embedded system 136 may be configured to communicatively couple to a wireless communication system 126. The wireless communication system 126 includes an antenna 166 and associated circuitry that enables wireless communications with global positioning system (GPS) satellites 162, a remote (dispatch) location 114, and/or a cell tower 164. For example, first embedded system 136 may include a port (not shown) that engages a respective connector that communicatively couples the one or more processors 158 and/or memory 160 to the wireless communication system 126. Alternatively, the first embedded system 136 may include the wireless communication system 126. The wireless communication system 126 may also include a receiver and a transmitter, or a transceiver that performs both receiving and transmitting functions.

Optionally, the first embedded system 136 is configured to communicatively couple to or includes a locator device 124. The locator device 124 is configured to determine a location of the vehicle system 102 on the route 104. The locator device 124 may be a global positioning system (GPS) receiver. In such embodiments, one or more components of the locator device may be shared with the wireless communication system 126. Alternatively, the locator device 124 may include a system of sensors including wayside devices (e.g., including radio frequency automatic equipment identification (RF AEI) tags), video or image acquisition devices, or the like. The locator device 124 may provide a location parameter to the one or more processors 158, where the location parameter is associated with a current location of the vehicle system 102. The location parameter may be communicated to the one or more processors 158 periodically or upon receiving a request. The one or more processors 158 may use the location of the vehicle system 102 to determine the proximity of the vehicle system 102 to one or more designated locations of the trip. For example, the designated locations may include points along the route that are proximate to restricted segments or within the restricted segments. The designated locations may also include an arrival location at the end of the trip, a passing loop location along the route 104 where another vehicle system on the route 104 is scheduled to pass the vehicle system 102, a break location for re-fueling, crew change, passenger change, or cargo change, and the like.

Also shown, the second embedded system 137 includes one or more processors 138 and memory 140. Optionally, the second embedded system 137 is configured to communicatively couple to multiple sensors 116, 132. For example, the second embedded system 137 may include ports (not shown) that engage respective connectors that are operably coupled to the sensors 116, 132. Alternatively, the second embedded system 137 may include the sensors 116, 132.

The multiple sensors are configured to monitor operating conditions of the vehicle system 102 during movement of the vehicle system 102 along the route 104. The multiple sensors may monitor data that is communicated to the one or more processors 138 of second embedded system 137 for processing and analyzing the data. For example, the sensor 116 may be a speed sensor 116 that is disposed on the vehicle system 102. In the illustrated embodiment, the speed sensors 116 are located on or near the trucks 118. Each speed sensor 116 is configured to monitor a speed of the vehicle system 102 as the vehicle system 102 traverses the route 104. The speed sensor 116 may be a speedometer, a vehicle speed sensor (VSS), or the like. The speed sensor 116 may provide a speed parameter to the one or more processors 138, where the speed parameter is associated with a current speed of the vehicle system 102. The speed parameter may be communicated to the one or more processors 138 periodically, such as once every second or every two seconds, or upon receiving a request for the speed parameter.

The sensors 132 may measure other operating conditions or parameters of the vehicle system 102 during the trip (e.g., besides speed and location). The sensors 132 may include throttle and brake position sensors that monitor the positions of manually-operated throttle and brake controls, respectively, and communicate control signals to the respective propulsion and braking subsystems. The sensors 132 may also include sensors that monitor power output by the motors of the propulsion subsystem and the brakes of the braking subsystem to determine the current tractive and braking efforts of the vehicle system 102. Furthermore, the sensors 132 may include string potentiometers (referred to herein as string pots) between at least some of the vehicles 108, 110 of the vehicle system 102, such as on or proximate to the couplers 123. The string pots may monitor a relative distance and/or a longitudinal force between two vehicles. For example, the couplers 123 between two vehicles may allow for some free movement or slack of one of the vehicles before the force is exerted on the other vehicle. As the one vehicle moves, longitudinal compression and tension forces shorten and lengthen the distance between the two vehicles like a spring. The string pots are used to monitor the slack between the vehicles of the vehicle system 102. The above represents a short list of possible sensors that may be on the vehicle system 102 and used by the second embedded system 137 (or the control system 100 more generally), and it is recognized that the second embedded system 137 and/or the control system 100 may include more sensors, fewer sensors, and/or different sensors.

In an embodiment, the control system 100 includes a vehicle characterization element 134 that provides information about the vehicle system 102. The vehicle characterization element 134 provides information about the make-up of the vehicle system 102, such as the type of cars 110 (for example, the manufacturer, the product number, the materials, etc.), the number of cars 110, the weight of cars 110, whether the cars 110 are consistent (meaning relatively identical in weight and distribution throughout the length of the vehicle system 102) or inconsistent, the type and weight of cargo, the total weight of the vehicle system 102, the number of propulsion vehicles 108, the position and arrangement of propulsion vehicles 108 relative to the cars 110, the type of propulsion vehicles 108 (including the manufacturer, the product number, power output capabilities, available notch settings, fuel usage rates, etc.), and the like. The vehicle characterization element 134 may be a database stored in an electronic storage device, or memory. The information in the vehicle characterization element 134 may be input using an input/output (I/O) device (referred to as a user interface device) by an operator, may be automatically uploaded, or may be received remotely via the communication system 126. The source for at least some of the information in the vehicle characterization element 134 may be a vehicle manifest, a log, or the like.

The control system 100 further includes a trip characterization element 130. The trip characterization element 130 is configured to provide information about the trip of the vehicle system 102 along the route 104. The trip information may include route characteristics, designated locations, designated stopping locations, schedule times, meet-up events, directions along the route 104, and the like. For example, the designated route characteristics may include grade, elevation slow warnings, environmental conditions (e.g., rain and snow), and curvature information. The designated locations may include the locations of wayside devices, passing loops, re-fueling stations, passenger, crew, and/or cargo changing stations, and the starting and destination locations for the trip. At least some of the designated locations may be designated stopping locations where the vehicle system 102 is scheduled to come to a complete stop for a period of time. For example, a passenger changing station may be a designated stopping location, while a wayside device may be a designated location that is not a stopping location. The wayside device may be used to check on the on-time status of the vehicle system 102 by comparing the actual time at which the vehicle system 102 passes the designated wayside device along the route 104 to a projected time for the vehicle system 102 to pass the wayside device according to the trip plan. The trip information concerning schedule times may include departure times and arrival times for the overall trip, times for reaching designated locations, and/or arrival times, break times (e.g., the time that the vehicle system 102 is stopped), and departure times at various designated stopping locations during the trip. The meet-up events includes locations of passing loops and timing information for passing, or getting passed by, another vehicle system on the same route. The directions along the route 104 are directions used to traverse the route 104 to reach the destination or arrival location. The directions may be updated to provide a path around a congested area or a construction or maintenance area of the route. The trip characterization element 130 may be a database stored in an electronic storage device, or memory. The information in the trip characterization element 130 may be input via the user interface device by an operator, may be automatically uploaded, or may be received remotely via the communication system 126. The source for at least some of the information in the trip characterization element 130 may be a trip manifest, a log, or the like.

The first embedded system 136 is a hardware and/or software system that is communicatively coupled to or includes the trip characterization element 130 and the vehicle characterization element 134. The first embedded system 136 may also be communicatively coupled to the second embedded system 137 and/or individual components of the second embedded system 137, such as the sensors 116, 132, 123. The one or more processors 158 receives input information from components of the control system 100 and/or from remote locations, analyzes the received input information, and generates operational settings for the vehicle system 102 to control the movements of the vehicle system 102. The operational settings may be contained in a trip plan. The one or more processors 158 may have access to, or receives information from, the speed sensor 116, the locator device 124, the vehicle characterization element 134, the trip characterization element 130, and at least some of the other sensors 132 on the vehicle system 102. The first embedded system 136 may be a device that includes a housing with the one or more processors 158 therein (e.g., within a housing). At least one algorithm operates within the one or more processors 158. For example, the one or more processors 158 may operate according to one or more algorithms to generate a trip plan.

By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. Memory, such as the memory 140, 160, can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like.

In an embodiment, using the information received from the speed sensor 116, the locator device 124, the vehicle characterization element 134, and trip characterization element 130, the first embedded system 136 is configured to designate one or more operational settings for the vehicle system 102 as a function of time and/or distance along the route 104 during a trip. The one or more operational settings are designated to drive or control the movements of the vehicle system 102 during the trip toward achievement of one or more objectives for the trip.

The operational settings may be one or more of speeds, throttle settings, brake settings, or accelerations for the vehicle system 102 to implement during the trip. Optionally, the one or more processors 138 may be configured to communicate at least some of the operational settings designated by the trip plan. The control signal may be directed to the propulsion subsystem, the braking subsystem, or a user interface device of the vehicle system 102. For example, the control signal may be directed to the propulsion subsystem and may include notch throttle settings of a traction motor for the propulsion subsystem to implement autonomously upon receipt of the control signal. In another example, the control signal may be directed to a user interface device that displays and/or otherwise presents information to a human operator of the vehicle system 102. The control signal to the user interface device may include throttle settings for a throttle that controls the propulsion subsystem, for example. The control signal may also include data for displaying the throttle settings visually on a display of the user interface device and/or for alerting the operator audibly using a speaker of the user interface device. The throttle settings optionally may be presented as a suggestion to the operator, for the operator to decide whether or not to implement the suggested throttle settings.

At least one technical effect of various examples of the inventive subject matter described herein may include an increased amount of automatic control time in which the human operator of the vehicle system does not manually control the vehicle system. Another technical effect may include generating, upon determining that a temporary work order is invalid, a new trip plan that is configured to have at least one of (a) a predicted trip duration that is essentially equal to the predicted trip duration of a prior trip plan or (b) a predicted fuel consumption that is less than the first predicted fuel consumption of the prior trip plan. Another technical effect may be providing information to the human operator for guiding the human operator for manually controlling the vehicle system through a restricted segment (or segment that is no longer associated with a temporary work order).

Figure 2:
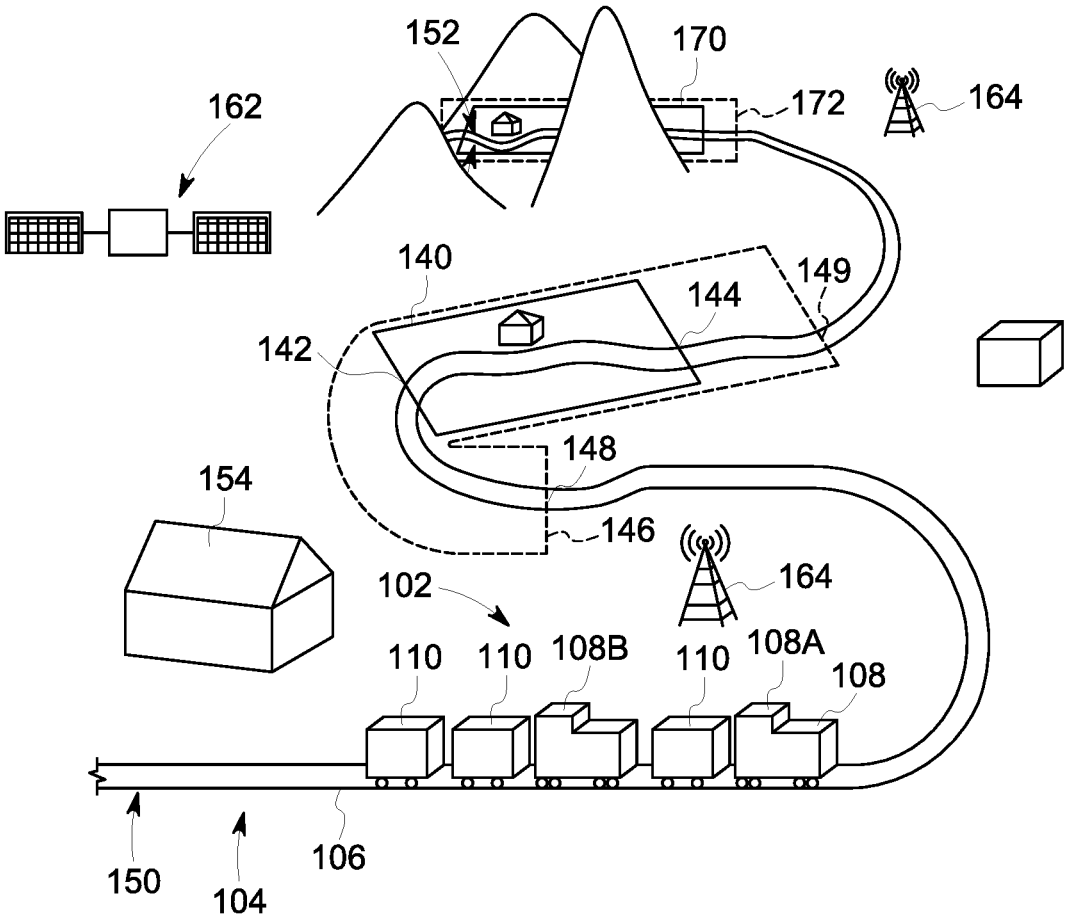
FIG. 2 is an illustration of a vehicle system traveling along a route in accordance with an embodiment.

FIG. 2 is an illustration of the vehicle system 102 traveling along the route 104 in accordance with an embodiment. As described above with respect to FIG. 1, the vehicle system 102 includes propulsion-generating vehicles 108A, 108B and three non-propulsion-generating vehicles 110. At least one of the propulsion-generating vehicles 108A, 108B includes the control system 100 (FIG. 1). The route 104 extends from a starting location 150 to a final destination location 152. The vehicle system 102 starts a trip along the route 104 at the starting location 150, and completes the trip at the final destination location 152. For example, the starting location 150 may be at or near a port, and the final destination location 152 may be at or near a mine, such as when the vehicle system 102 is set to travel from the port to the mine to receive a load of cargo at the mine to be transported back to the port. The trip may be, for example, tens, hundreds, or thousands of kilometers (or miles). A trip duration that is measured from the starting location 150 to the destination location 152 may be minutes or hours (e.g., 6 hours, 8 hours, 10 hours, 12 hours, or more).

In some embodiments, a trip represents the journey between a point at which the vehicle system begins moving and a point at which the vehicle system stops moving. In some embodiments, the trip includes all of the travel that a vehicle system 102 accomplishes in a single day. In other embodiments, however, a trip may only be one of multiple trips that are traveled in a single day by a vehicle system. For example, a vehicle system 102 may make three six-hour trips in a single day or four four-hour trips in a single day. As such, the term "trip" may be a portion of a longer trip or journey.

The vehicle system 102 may communicate wirelessly with an off-board system 154, the GPS satellites 162, and/or cell towers 164. Prior to the vehicle system 102 departing for the trip and/or as the vehicle system 102 moves along the route 104, the vehicle system 102 may be configured to communicate with the off-board system 154. The off-board system 154 may be configured to receive a request for trip data from the vehicle system 102, interpret and process the request, and transmit input information back to the vehicle system 102 in a response. The input information (or trip data) may include trip information, vehicle information, track information, and the like that may be used by the vehicle system 102 to generate a trip plan. As described above, the trip plan may be generated by the first embedded system 136 (FIG. 1). In other embodiments, the trip plan is generated by the control system generally using, for example, one or more embedded systems. Yet in other embodiments, the trip plan may be generated by the off-board system 154. Prior to the vehicle system 102 departing for the trip, the vehicle system 102 may also communicate with the GPS satellites 162 and/or the cell towers 164.

Vehicle information includes vehicle makeup information of the vehicle system 102, such as model numbers, manufacturers, horsepower, number of vehicles, vehicle weight, and the like, and cargo being carried by the vehicle system 102, such as type and amount of cargo carried. Trip information includes information about the upcoming trip, such as starting and ending locations, station information, restriction information (such as identification of work zones along the trip and associated speed/throttle limitations), and/or operating mode information (such identification of speed limits and slow orders along the trip and associated speed/throttle limitations). Track information includes information about the track 106 along the trip, such as locations of damaged sections, sections under repair or construction, the curvature and/or grade of the track 106, global positioning system (GPS) coordinates of the trip, weather reports of weather experienced or to be experienced along the trip, and the like. The input information may be communicated to the vehicle system 102 prior to the vehicle system 102 departing from the starting location 150. The input information may also be communicated to the vehicle system 102 after the vehicle system 102 has departed from the starting location 150.

The input information may also include a temporary work order, if one exists, that designates a restricted segment of the route 104 (e.g., the beginning point and the end point of the segment), a maximum speed through which the vehicle system 102 may travel through the restricted segment, and a limited time period in which the temporary work order is applied (e.g., 8:00 am-2:00 pm EST) to the restricted segment.

As the vehicle system 102 moves along the route 104, the vehicle system 102 may communicate with other wireless communication systems. For example, the vehicle system 102 may communicate with the GPS satellites 162 and/or the cell towers 164. The GPS satellites 162 may provide location information, such as latitude and longitude coordinates, that can be used to identify the location of the vehicle system 102 along the route 104. The GPS satellites 162 may also provide time information. For instance, the GPS satellites may communicate a present time to the vehicle system 102 that is expressed in a predetermined time standard (e.g., UTC). The cell towers may provide location information and/or time information. For example, the cell towers may communicate the present time based on the predetermined time standard or based on a regional time standard of the geographical region in which the vehicle system 102 is presently located. The cell towers may also provide location information that can be used to identify where the vehicle system 102 is located within the geographical region. In some embodiments, the vehicle system 102 may uses information from GPS satellites and information from cell towers.

As illustrated in FIG. 2, the route 104 includes a restricted segment 140. For example, the input information used to generate the trip plan included a temporary work order that specified a beginning point 142 and an end point 144 of the restricted segment 140. The temporary work order may be issued by, for example, a government agency or railroad that communicates with the off-board system 154. The temporary work order also includes a maximum speed that is permitted to travel through the restricted segment 140 and a limited time period in which the temporary work order is active or valid.

The trip plan generated by the vehicle system 102 (or the off-board system 154) may also specify a monitoring segment 146. The monitoring segment 146 may represent a portion of the route 104 that includes the restricted segment 140. The monitoring segment 146 is greater or longer than the restricted segment 140. While moving through the monitoring segment 146, the vehicle system 102 may determine whether the temporary work order has expired. For example, the monitoring segment 146 includes a beginning point 148 and an end point 149. As the vehicle system 102 moves through the monitoring segment 146 between the beginning and end points 148, 149, the vehicle system 102 may continuously or periodically determine a current time that is based, at least in part, on communications with GPS satellites 162 and/or the cell towers 164. The vehicle system 102 may then determine whether the temporary work order has expired based on the current time and the limited time period. In some embodiments, the vehicle system 102 determines a location of the vehicle system 102 along the route and then determines the current time based on the location.

Yet in other embodiments, the trip plan does not identify a monitoring segment 146 or a beginning point 148. In such embodiments, the vehicle system 102 may continuously or periodically (e.g., every second or every minute) determine the current time and determine whether any upcoming restricted segments or restricted segments that the vehicle system 102 is presently moving through have expired. For example, the trip plan may specify twenty temporary work orders for the trip. The vehicle system 102 (e.g., the control system 100 or the first embedded system 136) may determine, for each of the temporary work orders in the trip plan or for each of the temporary work orders in an upcoming series of work orders (e.g., the next five restricted segments or all restricted segments within the next 100 kilometers), whether the respective temporary work order has expired. If one or more of the temporary work orders have expired, the vehicle system 102 may generate another trip plan that removes speed restrictions for the restricted segment(s) associated with the expired work order(s). In some embodiments, the vehicle system 102 may communicate with the off-board system 154 to request updated input information prior to generating the other trip plan. In other embodiments, the vehicle system 102 may generate a new trip plan without receiving updated input information from the off-board system 154.

In some embodiments, the vehicle system 102 (or the control system) may modify the operational settings of the trip plan such that the vehicle system exceeds the maximum speed through the restricted segment. In such embodiments, the step of modifying the operational settings may occur prior to or as a new trip plan is generated. The step of modifying may include increasing the vehicle speed to a vehicle speed that is equal to or less than the speed limit when the temporary work order is not applied. For example, if the vehicle speed limit is 60 kph when the temporary work order is not applied, but 30 kph when the temporary work order is applied, the vehicle system 102 may increase the vehicle speed from 30 kph to 60 kph after determining that the temporary work order has expired. The vehicle system 102 may generate a new trip plan as the vehicle system 102 increases the vehicle speed or after the vehicle system 102 increases the vehicle speed.

As used in the detailed description and the claims, a trip plan may be generated before or after departure. During the trip, one or more new trip plans may be generated. When a new trip plan is implemented, the new trip plan becomes the existing trip plan or current trip plan and the next trip plan that is generated may be referred to as the new trip plan. For example, a new trip plan may be, numerically, the tenth trip plan generated by the vehicle system 102 during the trip between the starting location 150 and the final destination location 152. In this example, the ninth trip plan would be the "existing trip plan" or "current trip plan."

Also shown in FIG. 2, the route 104 includes another restricted segment 170 and monitoring segment 172. As described herein, the route 104 may include several restricted segments and, optionally, monitoring segments. The trip plan may be configured to control the vehicle system 102 so that the vehicle system 102 does not exceed the maximum speed through the restricted segment 170. However, due to delays along the trip, the temporary work order issued for the restricted segment 170 may expire prior to the vehicle system 102 entering the restricted segment 170 or as the vehicle segment moves through the restricted segment 170. Alternatively, due to the expiration of a temporary work order or temporary work orders, the vehicle system 102 may arrive at the restricted segment 170 sooner than predicted such that temporary work order for the restricted segment 170 is still valid. In such embodiments, the new trip plan may be configured to decrease the vehicle speed through the restricted segment 170 in order to satisfy the temporary work order.

Figure 3:
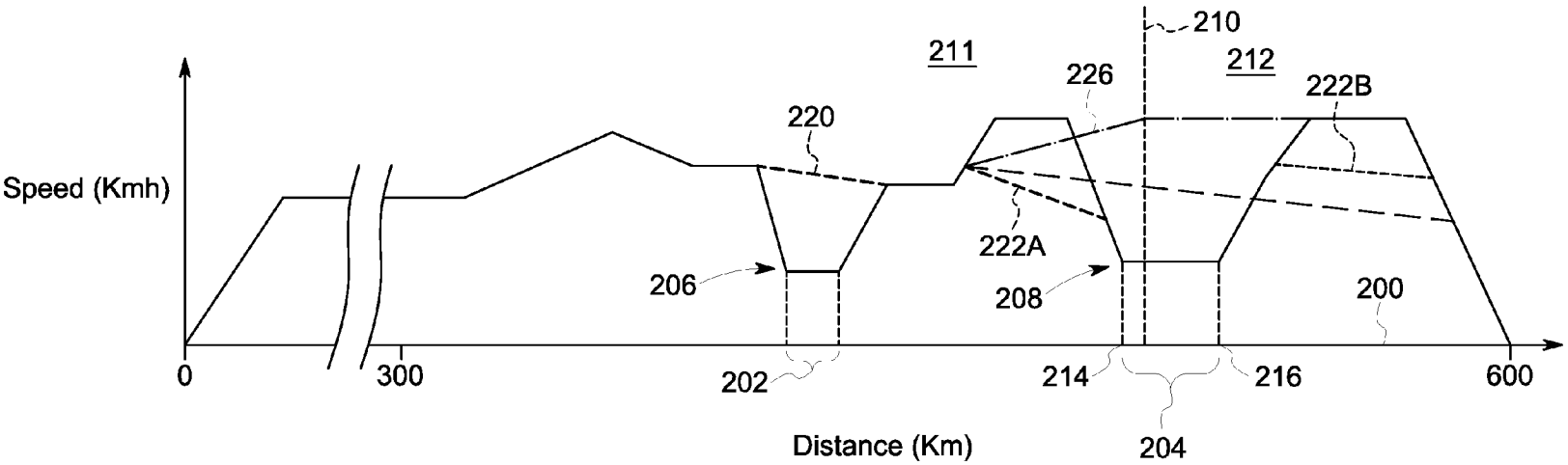
FIG. 3 illustrates a predicted speed profile of a trip and possible modifications to the speed profile after determining that a temporary work order has expired.
Figure 4:
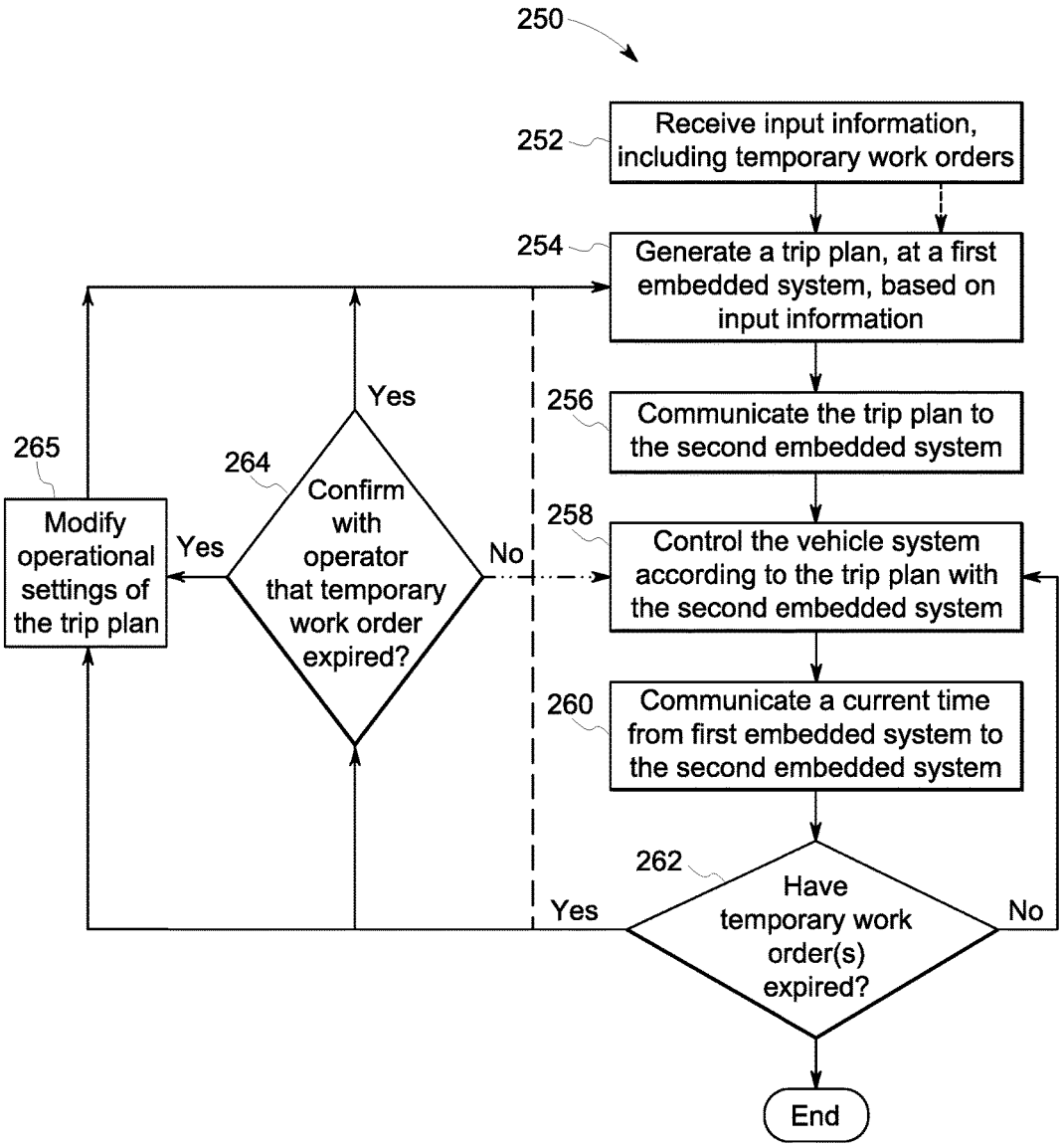
FIG. 4 is a flow chart illustrating a method (e.g., of operating a vehicle system) in accordance with an embodiment.

FIG. 3 illustrates a predicted speed profile (in solid lines) when a vehicle system begins a trip and possible changes to the speed profile (dashed lines) that may occur due to one or more temporary work orders expiring. The predicted speed profile may be determined by or based on the trip plan(s) that are generated for the route. FIG. 4 is a flow chart illustrating a method 250 (e.g., of operating a vehicle system) that is described with respect to the speed profile of FIG. 3. For illustrative purposes, FIG. 3 primarily shows the second half of the route between 300 km and 600 km. It should be understood, however, that the method 250 may be used throughout the route.

The horizontal axis in FIG. 3 between 0 km and 600 km represents the route 200. The route 200 includes restricted segments 202 and 204, but other restricted segments may exist in the first half of the route 200. Each of the restricted segments 202, 204 is associated with a temporary work order that specifies a maximum speed of a vehicle system moving through the restricted segment. The maximum speeds of the restricted segments 202, 204 are indicated at 206, 208, respectively. The vehicle system would be permitted to move through the restricted segments 202, 204 at greater vehicle speed if the temporary work orders did not exist or were expired. For example, the vehicle speed permitted when the temporary work order expires may be at least 1.5 times (1.5×) or at least 2 times (2×) the maximum speed specified by the temporary work order.

With respect to FIGS. 3 and 4, the method 250 may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method 250 is described as utilizing a first embedded system and a second embedded system. The first embedded system and the second embedded system may be separate embedded systems that are components of the same vehicle system. For example the first and second embedded systems may be components of the same locomotive. Each of the first and second embedded systems may communicate with different components. Alternatively, the first and second embedded systems may communicate with at least one common component (e.g., wireless communication system or designated sensor). As one example, the first embedded system is a CMU and the second embedded system is a CCA.

Each of the first and second embedded systems may have a respective system clock that is independent of a time standard and also independent from each other. For example, the system clocks may be based on when the respective embedded system is started (e.g., booted or initialized). It is contemplated that the system clocks may be essentially synchronized by simultaneously starting the first and second embedded systems at the same time. The system clocks may also be synchronized by communicating with each other and modifying the time of at least one of the system clocks so that the two system clocks are essentially synchronized.

Each of the first and second embedded systems may utilize their respective system clock during operation. For example, the first embedded system may record data and/or log events in a recorder in which the times logged are determined by the system clock of the first embedded system. Likewise, the second embedded system may utilize its system clock while implementing the trip plan and/or other functions of the second embedded system.

The method 250 includes receiving, at 252, input information for generating a trip plan. The input information may include data for generating a trip plan, such as those described above, and one or more temporary work orders. The input information may be received from a single source, such as a single off-board system, or from multiple sources. In addition to the off-board system, the sources may include an onboard component of the vehicle system. For example, the source may be a database that provides vehicle information (e.g., weight, number of cars) or a sensor that provides information on an operating condition. In an exemplary embodiment, the input information may be received, at 252, by the first embedded system or, more generally, the control system. In other embodiments, however, the off-board system may receive the input information to generate the trip plan remotely.

At 254, a trip plan may be generated that is based on (or a function of) the input information, including the temporary work orders. The trip plan may be generated prior to departure. The trip plan, however, may also be generated after departure. In an exemplary embodiment, the trip plan is generated by the first embedded system. More specifically, the first embedded system may analyze the input information and use one or more algorithms to generate a trip plan. The trip plan dictates or provides tractive settings and braking settings to be implemented by the vehicle system moving along the route. In addition to the settings, the trip plan may include at least one of a predicted speed profile, a predicted trip duration, a predicted arrival time at the final destination, a predicted fuel consumption, or predicted fuel emissions (e.g., for the entire route or for a portion of the route that remains after a designated point along the route). Alternatively, the trip plan may include information that is sufficient for calculating the predicted speed profile, the predicted trip duration, the predicted arrival time at the final destination, the predicted fuel consumption, and/or the predicted fuel emissions. The predicted speed profile may be similar or identical to the predicted speed profile shown in FIG. 3.

As described above, the trip plan may also be based on one or more temporary work orders issued for restricted segments along the route, such as the restricted segments 202, 204. The trip plan may be based on ten, twenty, thirty, or more temporary work orders in which each temporary work order provides a maximum speed through the restricted segment and a limited time period in which the maximum speed restriction is implemented. The limited time period may be expressed using a designated time standard. The designated time standard may be, for example, UTC or a regional time standard of the geographical region that includes the restricted segment.

The trip plan may be based on temporary work orders that are located in different time zones. In some cases, a temporary work order may correspond to a restricted segment that extends through a boundary between two different time zones. For example, a line 210 is shown in FIG. 3 that indicates a boundary between first and second time zones 211, 212. The restricted segment 204 extends through each of the first and second time zones 211, 212 such that portions of the restricted segment 204 are located in different time zones. More specifically, a beginning point 214 of the restricted segment 204 is located within the first time zone 211, and an end point 216 of the restricted segment 204 is located within the second time zone 212. As such, in some embodiments, the trip plan includes limited time periods that are expressed in different time standards (e.g., EST, central time standard (CST), mountain standard time (MST), etc.). Although the examples provided are in the United States, it should be understood that the restricted segments may exist in other countries that use different time standards.

After generating the trip plan, at 254, the trip plan may be communicated, at 256, to the vehicle system or the control system. If the trip plan was generated, at 256, by the vehicle system, the trip plan may be communicated to the designated embedded system (e.g., the second embedded system). Optionally, the system that generates the trip plan, at 254, may also control operation of the vehicle system in accordance with the trip plan. In such alternative embodiments, the step of communicating the trip plan, at 256, is not necessary to perform.

The vehicle system is controlled, at 258, according to the trip plan. In particular embodiments, the second embedded system receives the trip plan from the first embedded system and implements the trip plan by, at least in part, controlling operation of traction motors and braking subsystems.

At 260, a current time may be communicated to the system (e.g., control system or second embedded system) that is controlling the vehicle system. In the illustrated embodiment, the current time is communicated from the first embedded system to the second embedded system. In some embodiments, the current time may be communicated only upon request from the system that is controlling the vehicle system. In other embodiments, the current time may be continuously or periodically sent by the first embedded system without a request from the second embedded system.

The current time may be expressed in a designated time standard (e.g., UTC) or expressed in a regional time standard of the geographical region that includes the restricted segment. For embodiments in which the current time is expressed in the regional time standard, the current time is referred to as the local time. As one example, the first embedded system may communicate that the current time is 13:25 UTC or, alternatively, the first embedded system may communicate that the local time is 10:25 EST (if the regional time standard is EST).

For embodiments in which the current time is expressed in the regional time standard, the current time may be converted into the regional time standard by the control system. In particular embodiments, the current time is converted into the regional time standard by the first embedded system. For example, the first embedded system may be configured to communicate wirelessly with a remote system, such as a GPS satellite or a cell tower. The first embedded system may receive time data and location data from the remote system. The time data may correspond to the current time in the designated time standard (or other known time standard). The first embedded system may continuously or periodically (e.g., every second, every five seconds, every ten seconds, etc.) receive time data and location data from the remote system. Alternatively, the first embedded system may request the time data and location data from the remote system at designated events, such as receiving a request for the current time from the second embedded system.

As such, the current time may be communicated from the remote system to the first embedded system. The location data may be used to identify where the vehicle system is located at the current time. For example, the GPS satellite may communicate current time and latitude and longitude coordinates to the first embedded system. The first embedded system may include a database that defines a path of the route in latitude and longitude coordinates. The first embedded system may compare the latitude and longitude coordinates from the GPS satellite to the latitude and longitude coordinates in the database to identify a location of the vehicle system at the current time. This location may be referred to as the current location or present location.

Using the current location, the first embedded system may be configured to determine a regional time standard of the geographical region that includes the restricted segment. With the current time known in the designated time standard (e.g., UTC), the first embedded system may convert the current time in the designated time standard to a current time (or local time) in the regional time standard. The local time may be communicated from the first embedded system to the second embedded system. As described below, the second embedded system (or the control system) may use the local time to determine if a temporary work order has expired.

Yet in other embodiments, the system that is controlling operation of the vehicle system may communicate directly with the remote system. For example, the second embedded system may be configured to communicate with a GPS satellite and/or cell tower to determine the current time and location of the vehicle system. The second embedded system may then convert the current time into a local time, if necessary, using the process described above with respect to the first embedded system.

The current time may be communicated to the second embedded system as the vehicle system approaches a restricted segment or as the vehicle system moves through the restricted segment. For example, it may be possible that a temporary work order expires while the vehicle system is located within the restricted segment. In some embodiments, the current time is continuously or periodically received by the second embedded system (or the control system). In other embodiments, the second embedded system may request the current time from the first embedded system at a designated point along the route. For example, the trip plan may identify when to request the current time from the first embedded system.

In some embodiments, the second embedded system may maintain a current clock in addition to the system clock. The current clock may have a time that is kept by the second embedded system and that is based on a previously-determined offset with respect to the system clock of the second embedded system. Such embodiments may be useful when vehicle systems are located in dead zones where wireless communication with remote system has failed or is not reliable. More specifically, prior to arriving at a restricted segment, the second embedded system may receive a current time. The second embedded system may determine that system clock is offset with respect to the current time by a designated value. The designated value may be, for example, in seconds or minutes. With the offset known, the second embedded system may be able to determine a current time. Similar to above, it may be necessary to modify the offset when crossing multiple time zones.

At 262, the second embedded system (or the control system) may query whether the temporary work order of an approaching restricted segment has expired or whether the temporary work orders of approaching restricted segments have expired. For example, the second embedded system may analyze all of the remaining temporary work orders or a select number of temporary work orders. The select number may be, for example, a series of temporary work orders (e.g., the next five temporary work orders) or the temporary work orders located within a designated distance (e.g., any work orders for restricted segments in the next 100 km).

As described above, the trip plan may specify the limited time period in which a temporary work order is valid. Using the current time (or local time), the second embedded system may determine whether the temporary work order has expired. If the temporary work order has expired (or subsequent temporary work orders have expired), the method may at least one of (1) generate, at 254, a new trip plan, (2) prompt or query, at 264, the human operator to confirm that the temporary work order has expired, or (3) modify, at 265, the operational settings of the trip plan such that the vehicle system exceeds the maximum speed through the restricted segment. In some embodiments, the method may perform more than one of the above steps. For example, after determining that the temporary work order has expired, the operator may be prompted or queried to confirm that the temporary work order has expired. Upon receiving confirmation from the operator, the operational settings are modified to increase the vehicle speed. As the vehicle speed is increased, a new trip plan may be generated. As another example, after determining that the temporary work order has expired, the operational settings may be automatically modified to increase the vehicle speed. As the vehicle speed is increased, a new trip plan may be generated. Yet in another example, after determining that the temporary work order has expired, a new trip plan may be generated. The last example may be performed when, for instance, a subsequent temporary work order has expired.

If the temporary work order has not expired, the method 250 may return to controlling the vehicle system, at 258, according to the trip plan. If the second embedded system determines that the temporary work order has expired, but the human operator does not confirm the expiration of the temporary work order, the method 250 may return to controlling the vehicle system, at 258, according to the trip plan.

As described herein, the method 250 may automatically generate a new trip plan, at 254, in response to determining that the temporary work order (or temporary work orders) has expired. This automatic path is indicated by the dashed line between the query 262 and the block 254. It should be understood, however, that both paths may be taken. For example, after determining that the temporary work order has expired, the method 250 may ask the human operator, at 264, whether the temporary work order has expired and also automatically instruct the control system (or first embedded system) to begin generating a new trip plan.

When the control system asks the human operator, at 264, to confirm that the temporary work order has expired, the control system may display the temporary work order (or orders) on a user interface (e.g. user display, screen, touchscreen, or the like) that is disposed onboard the vehicle system. For example, the second embedded system may identify the temporary work order by an order number or by mile markers. The second embedded system may also display the limited time period for the temporary work order. The human operator may then determine whether the temporary work order has expired. The human operator may also communicate remotely to determine whether the temporary work order has expired.

When a new trip plan is generated, at 254, the first embedded system (or the control system) may generate a new trip plan in which the vehicle system exceeds the maximum speed through the restricted segment with the expired work order. Returning to FIG. 3, the restricted segment 202 includes an alternative speed profile in which the vehicle system exceeds the maximum speed 206. This vehicle speed is referenced at 220. Because the vehicle system was permitted to exceed the maximum speed for the restricted segment 202, the vehicle system may have a different speed profile for a remainder of the trip.

At 254, the new trip plan may be created to achieve one or more objectives. For example, the new trip plan may be configured to have at least one of (a) a new predicted trip duration that is essentially equal to the prior predicted trip duration or (b) a new predicted fuel consumption that is less than the predicted fuel consumption from the prior trip plan. In some embodiments, a trip duration is essentially equal to another trip duration if the trip durations are within 5% of each other. For example, if the trip duration of the original plan was 8 hours, the trip duration of the new trip plan is essentially equal to the original trip duration if the new trip duration is eight hours +/−24 minutes. In more particular embodiments, a trip duration is essentially equal to another trip duration if the trip durations are within 3% of each other or within 2% of each other. In some embodiments, a trip duration is essentially equal to another trip duration if the trip durations are within 15 minutes of each other. In more particular embodiments, a trip duration is essentially equal to another trip duration if the trip durations are within 10 minutes of each other or within 5 minutes of each other. Optionally, the new trip plan may have a slower average vehicle speed after the restricted segment compared to the average vehicle speed of the prior trip plan after the restricted segment.

When the new trip plan is generated, at 254, the control system (or the first embedded system) may use only the prior trip plan and the new information that the temporary work order has expired. In other embodiments, the control system may use updated input information. For example, the first embedded system may communicate with a remote system (e.g., off-board system) that provides information that has changed since the last communication between the first embedded system and the remote system. The new or updated information is represented by the dashed arrow in FIG. 3.

FIG. 3 also illustrates how the predicted speed profile may change in the new trip plan after determining that the temporary work order for the restricted segment 202 had expired. Three alternative profiles are shown. A first alternative (indicated at 222A, 222B) may be implemented if the temporary work order for the restricted segment 204 remains valid during the trip. At 222A, the vehicle system may coast toward the restricted segment 204. At 222B, the vehicle system may have a decreased speed for a portion of the route 200 because the vehicle system was permitted to travel at a greater vehicle speed through the restricted segment 202. In this example, the trip duration may be essentially equal and the fuel consumption during the trip may be less.

The portion of the speed profile referenced at 224 indicates a speed profile in which the temporary work order for the restricted segment 204 has expired. In this example, the speed of the vehicle system may gradually decrease as the vehicle system approaches the final destination. The portion of the speed profile referenced at 226 indicates another speed profile in which the temporary work order for the restricted segment 204 has expired. In this example, the speed of the vehicle system is greater to allow the vehicle system to arrive at the final destination earlier or to allow the vehicle system to make up for delays that occurred during the first half of the route.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. The various embodiments are not limited to the arrangements and instrumentality shown in the drawings.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A system comprising:

a control system that is disposed onboard a vehicle system, the control system including one or more processors, the control system configured to:

generate a trip plan that dictates operational settings to be implemented by the vehicle system moving along a route, the trip plan being based on a temporary work order issued for a restricted segment of the route, the temporary work order providing a maximum speed through the restricted segment for a limited time period that is expressed using a designated time standard, wherein one or more of the operational settings of the trip plan specify movement of the vehicle system through the restricted segment at a vehicle speed that is less than or equal to the maximum speed;

control the vehicle system in accordance with the trip plan as the vehicle system moves along the route;

determine a current time as the vehicle system approaches the restricted segment or moves through the restricted segment, the current time being expressed using the designated time standard or a different time standard that is a function of the designated time standard; and determine that the temporary work order has expired based on the current time and the limited time period of the temporary work order, wherein, in response to determining that the temporary work order has expired, the control system is configured to at least one of prompt an operator of the vehicle system to confirm that the temporary work order has expired, generate a new trip plan in which the vehicle system exceeds the maximum speed through the restricted segment, or modify the operational settings of the trip plan such that the vehicle system exceeds the maximum speed through the restricted segment.

2. The system of claim 1, wherein the trip plan has a first predicted trip duration and a first predicted fuel consumption and wherein the one or more processors are configured to generate the new trip plan, the new trip plan configured to have at least one of (a) a second predicted trip duration that is essentially equal to the first predicted trip duration or (b) a second predicted fuel consumption that is less than the first predicted fuel consumption.

3. The system of claim 1, further comprising a system clock that is independent of the designated time standard, the trip plan being executed by the vehicle system using the system clock.

4. The system of claim 1, wherein the control system includes first and second embedded systems, the first embedded system including one or more of the processors and memory and the second embedded system including one or more of the processors and memory, the first embedded system being communicatively coupled to an antenna and being configured to receive input information from an off-board system, the first embedded system configured to generate the trip plan using the input information, the second embedded system configured to control the vehicle system in accordance with the trip plan as the vehicle system moves along the route.

5. The system of claim 4, wherein the current time is a local time along the restricted segment, the first embedded system configured to determine the local time using a location of the vehicle system as the vehicle system approaches the restricted segment or moves through the restricted segment, the first embedded system configured to communicate the local time to the second embedded system, the second embedded system configured to determine that the temporary work order has expired based on the local time and the limited time period of the temporary work order, wherein each of the first and second embedded systems has a system clock that is independent from the other.

6. The system of claim 1, wherein the system includes a rail vehicle of the vehicle system having the control system.

7. The system of claim 1, wherein the temporary work order specifies an expiration time of the temporary work order in the designated time standard, the designated time standard being a regional time standard of the geographical region that includes the restricted segment.

8. The system of claim 1, wherein the control system is configured, in response to determining that the temporary work order has expired, to prompt the operator of the vehicle system, onboard the vehicle system, to confirm that the temporary work order has expired, and responsive to the operator confirming that the temporary work order has expired, to at least one of generate the new trip plan in which the vehicle system exceeds the maximum speed through the restricted segment or modify the operational settings of the trip plan such that the vehicle system exceeds the maximum speed through the restricted segment.

9. A method comprising:

generating a trip plan that dictates operational settings to be implemented by a vehicle system moving along a route, the trip plan being based on a temporary work order issued for a restricted segment of the route, the temporary work order providing a maximum speed through the restricted segment for a limited time period that is expressed using a designated time standard, wherein one or more of the operational settings of the trip plan specify movement of the vehicle system through the restricted segment at a vehicle speed that is less than or equal to the maximum speed;

controlling the vehicle system in accordance with the trip plan as the vehicle system moves along the route;

determining a current time as the vehicle system approaches the restricted segment or moves through the restricted segment, the current time being expressed using the designated time standard or a different time standard that is a function of the designated time standard; and determining that the temporary work order has expired based on the current time and the limited time period of the temporary work order, wherein, in response to determining that the temporary work order has expired, the method includes at least one of prompting an operator of the vehicle system to confirm that the temporary work order has expired, generating a new trip plan in which the vehicle system exceeds the maximum speed through the restricted segment, or modifying the operational settings of the trip plan such that the vehicle system exceeds the maximum speed through the restricted segment.

10. The method of claim 9, wherein the trip plan has a first predicted trip duration and a first predicted fuel consumption and wherein the method includes generating the new trip plan, the new trip plan configured to have at least one of (a) a second predicted trip duration that is essentially equal to the first predicted trip duration or (b) a second predicted fuel consumption that is less than the first predicted fuel consumption.

11. The method of claim 9, wherein the vehicle system includes an embedded system that is disposed onboard the vehicle system and performs the step of generating the trip plan, the method further comprising receiving, at the embedded system, the temporary work order that is applied to the restricted segment.

12. The method of claim 11, wherein the embedded system is a first embedded system and the vehicle system includes a second embedded system disposed onboard the vehicle system, the first embedded system generating the trip plan, the second embedded system controlling the vehicle system to execute the trip plan.

13. The method of claim 12, wherein the current time is a local time along the restricted segment, the first embedded system determining the local time using a location of the vehicle system as the vehicle system approaches the restricted segment or moves through the restricted segment, the first embedded system communicating the local time to the second embedded system, the second embedded system determining that the temporary work order has expired based on the local time and the limited time period of the temporary work order.

14. The method of claim 9, wherein the vehicle system includes a system clock that is independent of the designated time standard, the trip plan being executed by the vehicle system using the system clock.

15. The method of claim 9, wherein the temporary work order is one of plural temporary work orders and the trip plan is based on each of the plural temporary work orders, each of the temporary work orders being applied to a separate restricted segment along the route, wherein at least two of the restricted segments are located in different time zones.

16. The method of claim 9, wherein the temporary work order specifies an expiration time of the temporary work order in the designated time standard, the designated time standard being a regional time standard of the geographical region that includes the restricted segment.

17. The method of claim 9, wherein the vehicle system includes a rail vehicle.

18. The method of claim 9, wherein, in response to determining that the temporary work order has expired, the method includes prompting the operator of the vehicle system, onboard the vehicle system, to confirm that the temporary work order has expired, and in response to the operator confirming that the temporary work order has expired, at least one of generating the new trip plan in which the vehicle system exceeds the maximum speed through the restricted segment or modifying the operational settings of the trip plan such that the vehicle system exceeds the maximum speed through the restricted segment.

19. A method comprising:

generating a trip plan at a first embedded system that is disposed onboard a vehicle system, the trip plan providing operational settings to be implemented by the vehicle system moving along a route, the trip plan being based on a temporary work order issued for a restricted segment of the route, the temporary work order providing a maximum speed through the restricted segment for a limited time period that is expressed using a designated time standard, wherein one or more of the operational settings of the trip plan specify movement of the vehicle system through the restricted segment at a vehicle speed that is less than or equal to the maximum speed;

controlling the vehicle system in accordance with the trip plan as the vehicle system moves along the route, the vehicle system being controlled by a second embedded system;

determining a current time, at the first embedded system, as the vehicle system approaches the restricted segment or moves through the restricted segment, the current time being expressed using the designated time standard or a different time standard that is a function of the designated time standard; and determining, at the second embedded system, that the temporary work order has expired based on the current time and the limited time period of the temporary work order, wherein, in response to determining that the temporary work order has expired, the method includes at least one of prompting an operator of the vehicle system to confirm that the temporary work order has expired, generating a new trip plan in which the vehicle system exceeds the maximum speed through the restricted segment, or modifying the operational settings of the trip plan such that the vehicle system exceeds the maximum speed through the restricted segment.

20. The method of claim 19, wherein the first embedded system includes one or more processors and memory and the second embedded system includes one or more processors and memory, the first embedded system including an antenna and being configured to receive input information from an off-board system for generating the trip plan, the second embedded system configured to control one or more traction motors of the vehicle system.

21. The method of claim 19, wherein the trip plan has a first predicted trip duration and a first predicted fuel consumption and wherein the method includes generating the new trip plan, the new trip plan configured to have at least one of (a) a second predicted trip duration that is essentially equal to the first predicted trip duration or (b) a second predicted fuel consumption that is less than the first predicted fuel consumption.

22. The method of claim 19, wherein the current time is a local time along the restricted segment, the first embedded system determining the local time using a location of the vehicle system as the vehicle system approaches the restricted segment or moves through the restricted segment, the first embedded system communicating the local time to the second embedded system, the second embedded system determining that the temporary work order has expired based on the local time and the limited time period of the temporary work order.

23. The method of claim 19, wherein, in response to determining that the temporary work order has expired, the method includes prompting the operator of the vehicle system, onboard the vehicle system, to confirm that the temporary work order has expired, and responsive to the operator confirming that the temporary work order has expired, at least one of generating the new trip plan in which the vehicle system exceeds the maximum speed through the restricted segment or modifying the operational settings of the trip plan such that the vehicle system exceeds the maximum speed through the restricted segment.

* * * * *